United States Patent [19]

Martin

[11] 4,408,403

[45] Oct. 11, 1983

[54] SPORTS SHOE OR BOOT

[76] Inventor: Hans Martin, Chasernweg 7, Kloten, Switzerland

[21] Appl. No.: 289,171

[22] Filed: Aug. 3, 1981

[30] Foreign Application Priority Data

Aug. 11, 1980 [CH] Switzerland ..... 6069/80
Feb. 27, 1981 [CH] Switzerland ..... 1351/81

[51] Int. Cl.[3] ..... A43B 5/04; A43B 11/00; A43B 5/16

[52] U.S. Cl. ..... 36/115; 36/50; 36/54; 36/56; 36/117

[58] Field of Search ..... 36/117, 121, 50, 54, 36/56, 115, 68, 69, 118, 119, 99

[56] References Cited

U.S. PATENT DOCUMENTS

| | | | |
|---|---|---|---|
| 2,109,751 | 3/1938 | Matthias et al. | 36/99 |
| 3,545,106 | 12/1970 | Martin | 36/50 |
| 3,975,838 | 8/1976 | Martin | 36/121 |
| 4,142,307 | 3/1979 | Martin | 36/50 |
| 4,190,970 | 3/1980 | Annovi | 36/117 |
| 4,222,184 | 9/1980 | Kastinger | 36/118 |

FOREIGN PATENT DOCUMENTS

| | | | |
|---|---|---|---|
| 1816811 | 6/1970 | Fed. Rep. of Germany | 36/121 |
| 2450575 | 11/1980 | France | 36/50 |
| 2473280 | 7/1981 | France | 36/114 |
| WO80/02789 | 12/1980 | PCT Int'Appl. | 36/119 |

*Primary Examiner*—Werner H. Schroeder
*Assistant Examiner*—Steven N. Meyers
*Attorney, Agent, or Firm*—Roylance, Abrams, Berdo & Farley

[57] ABSTRACT

A sports shoe or boot having an upper and a shaft or leg plate is provided with a tightening system comprising a tightening member and a pull cord. The pull cord is arranged in turns over the openable closing flaps of the upper and is protected by a covering tongue. A turn of the pull cord is guided out of the area of the covering tongue by means of a slot in the latter and is held on the shaft by means of a tubular guide piece with a cover strap. Placing the turn on the upper part of the covering tongue ensures that no additional fastening means are required for the tongue. The boot can be completely tightened with a single tightening member.

14 Claims, 6 Drawing Figures

SPORTS SHOE OR BOOT

This invention relates to an improved sports shoe or boot, particularly for ice hockey, having an upper with openable instep flaps and tightening means including a pull cord and a tightening member.

BACKGROUND OF THE INVENTION

Sports shoes or boots which have a tightening means provided with a pull cord and a tightening member are known as shown, for example, in German OS No. 2,800,187, in which the tightening member is placed on the instep portion of the boot. With such boots it is possible to cover the pull cord on the instep side with a covering tongue. This tongue can be arranged in an articulated manner in the vicinity of the cap or toe of the boot so that it does not impede the putting on and taking off of the boot. After putting on the boot, the covering tongue is placed over the instep and secured with the tightening member. Thus, a separate fastening of the tongue is required.

In another known construction, as shown in Swiss Pat. No. 612,076, tightening members are provided at the back. The pull cord passes between the closing flaps and runs in the same way as for a tightening member located at the instep side, but is extended toward the rear. This construction is advantageous if a slight flexibility is required in the ankle area of the boot and the tightening device is to be protected, for example, as in the case of an ice hockey boot. However, it must also be possible to protect the entire length of the pull cord by, for example, a covering tongue. In the case of a tightening member arranged on the instep side, the covering tongue can be held by means of the latter, but this is not the case when the tightening member is positioned at the back so it is necessary to provide an additional fastening for the tongue.

BRIEF SUMMARY OF THE INVENTION

An object of the present invention is to provide a sports shoe or boot having an upper with openable instep flaps and a tightening arrangement including a pull cord and a tightening member wherein the pull cord can be protected by suitable means without the necessity for using additional fastening means.

Briefly described, the invention includes an improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member the improvement comprising a covering tongue coupled to the upper at the cap portion thereof, said covering tongue extending over the openable instep flaps; mounting means on said covering tongue for receiving a portion of said pull cord; and a guide member spaced from said covering tongue for receiving and guiding said pull cord.

With this arrangement, the covering tongue is held in place by at least one of the turns formed by the pull cord which is, in each case, required by tightening the boot.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification and wherein.

Figure 1:
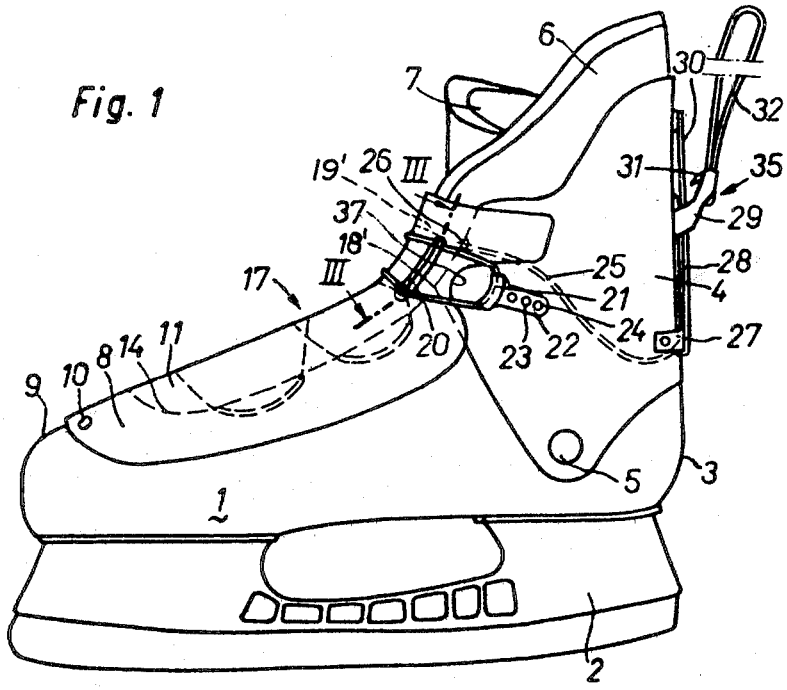
FIG. 1 is a side elevation of an ice hockey boot in accordance with the present invention.

Referring now to the drawings in detail, it will be seen that FIG. 1 shows an ice hockey boot having an upper 1 integrally connected to a sole and having a skate 2 connected to the bottom of the sole in a conventional manner, not shown. The construction of the skate portion 2 is of no importance to the present invention and will not be further described.

The upper 1 extends up to the ankle and to heel 3. A shaft or leg plate 4 is hingedly connected to opposite sides of the upper at hinge points 5, only one of which is visible in the figures. An inner shoe 6 made from a pad material having an inner tongue 7 is inserted in the outer structure of the upper formed by upper 1 and leg plate 4. Upper 1 and plate 4 are open on the instep side, the opening being covered by a covering tongue 8 which is attached in an articulated manner to the upper in the vicinity of toe or cap 9 by, for example, a rivet 10. Covering tongue 8 performs the function of protecting the open instep side of the boot and the underlying parts from, for example, blows from hockey sticks.

Figure 2:
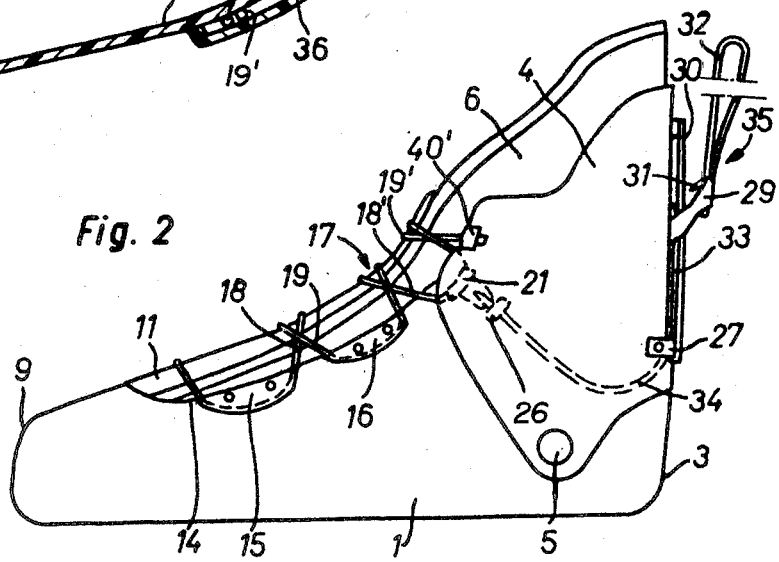
FIG. 2 is a side elevation of a boot similar to FIG. 1 with a modified tightening means.

The opening 11 formed in upper 1 is bounded by openable closing flaps 14, this also being seen in FIG. 2 in which only one flap is visible. Connected to these flaps fixed by fasteners, such as rivets, are curved guide pieces 15 and 16 around which are guided a pull cord 17 which can be a steel cable. Pull cord 17 includes two partial cords 18, 19 which cross over opening 11 and alternately extend from one closing flap 14 to the other. The path followed by the cords as they are guided around the guide pieces is indicated by dotted lines in FIG. 1. The pull cord 17 consisting of the two partial cords 18, 19 could be replaced by two pull cords fixed to upper 1 in the vicinity of the boot cap. However, it is possible to use only a single pull cord 17 and fix one end in the vicinity of cap 9. In this case, no cord crossings are formed over opening 11.

In the instep side region of the ankle, the two partial cords 18, 19 form turns 18', 19' which are passed through a slot 20 in covering tongue 8 and run over the top thereof. Turns 18', 19' are laterally passed out of the area of covering tongue 8 and are held in position on each side by a tubular guide piece 21. These guide pieces 21, one of which is on each side of the boot, are fixed by securing straps 22 to leg plate 4. To permit a change in the length of turns 18', 19', each strap 22 has a plurality of holes 23 which can be selectively placed over a pin or hook 24 fixedly attached to the leg plate, as desired. Thus, turns 18', 19' can easily be detached from plate 4, permitting the covering tongue 8 to be moved away from the instep.

Following the formation of turns 18', 19', each of the partial cords 18, 19 extends through a tubular or channel-like guide 25 one end of which is attached at the instep side edge of plate 4 by a support 26 and the other end of which is anchored at the calf side in a clip member 27. The two ends 28 of partial cords 18, 19 are secured in a slide 29 which is guided displaceably on a rail member 30 extending vertically along the calf side. Slide member 29 has a hook 31 which is directed inwardly toward rail member 30, and also downwardly, and which can be engaged in any one of a plurality of suspension openings in rail member 30, not visible in the figures. By means of a pull loop 32, slide member 29 can be drawn upwardly so that pull cord 17 and therefore, the boot are tightened. Slide member 29, rail member 30, hook 31 and pull loop 32 together form the tightening member assembly 35, while the boot tightening means comprises pull cord 17 and tightening member 35.

When putting on or taking off the sport boot of FIG. 1, the two guide pieces 21 with their straps 22 are disconnected from the hooks on plate 4 and then covering tongue 8 can be raised. If, in addition slide member 29 is disengaged and moved to the lower end of rail member 30, it is possible to raise tongue 8 still further. There is now sufficient space to insert one's foot in the boot or to remove it therefrom. With this arrangement of turns 18', 19', when the boot is tightened, covering tongue 8 is reliably held on the boot instep without any additional means being required and, consequently, covers the underlying pull cord 17.

Figure 3:
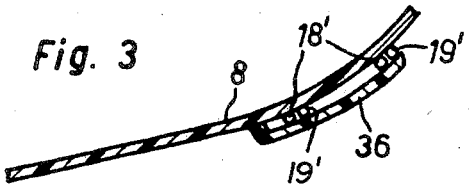
FIG. 3 is a partial sectional view along line III—III of FIG. 1.

As shown in FIG. 3, slot 20 can be replaced by a hook 36 made from a flexible material and positioned on the bottom of tongue 8. The two turns 18', 19' pass through hook 36 and are guided laterally out of the area of tongue 8. In the same way, as shown in FIG. 1, they can be adjustably fixed to shaft 4 by guide pieces 21 and straps 22.

Because the two turns 18', 19' are located in the vicinity of the instep side part of the ankle, it is desirable to make the covering tongue 8 as flexible as possible. This can be achieved with the aid of slot 20 and/or by a recess 37 on tongue 8.

Whereas in the case of the embodiment of FIG. 1, the ends of the two partial cords are connected to the tightening member 35, in the embodiment of FIG. 2 the partial cords 18, 19 terminate at the instep side portions of plate 4 where they are fixed to the plate by clips 40'. Turns 18', 19' are then led out of the area of covering tongue 8, either by slot 20 according to FIG. 1, or through hooks 36 as shown in FIG. 3. The tubular guide pieces 21 provided on turns 18', 19' are connected to a tightening cord 33 running through a channel shaped or tubular guide 34, like guide 25 in FIG. 1, on the inside of plate 4 and anchored at its two ends in clip member 27 or support provided on plate 4. As can be gathered from FIG. 2, the tubular guide piece 21 can also be positioned below shaft 4.

If necessary, turns 18', 19' can be covered, for example, by cover straps, thereby protecting the turns. The sports boot according to FIGS. 1 and 2 is tightened in the same way. Using pull 32, slide member 29 is drawn vigorously upwardly and then hook 31 is hung in one of the suspension openings in rail member 30. In order to release the tightening arrangement, the hook 31 is removed from the suspension opening by gently tilting the slide member, and the slide member is then lowered. The travel of the slide member between the tightened and lowered positions is a measure of the release length of the covering tongue. Because there is plenty of space for the rail member 30 on the calf side of the boot, an adequate release length of covering tongue 8 can also be achieved with the construction according to FIG. 2. In the embodiment of FIG. 1, the release length is longer because, in addition to the travel length of slide member 29 between the tightened and lowered positions, there is also the length of turns 18', 19' which are slack after the release of straps 22.

Figure 4:
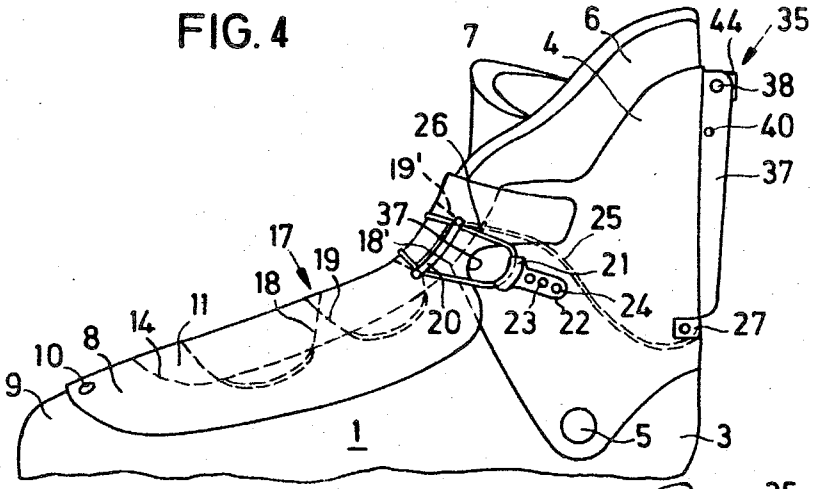
FIG. 4 is a partial side elevation of a sports boot with pull cords on the instep side and a tightening member at the calf side.
Figure 5:
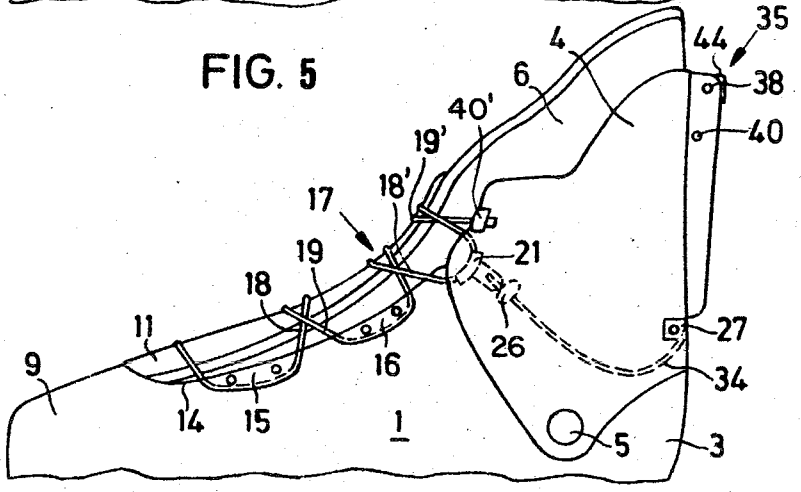
FIG. 5 is a partial side elevation of the boot of FIG. 4 with a modified arrangement of the pull cords.

The sports boot of FIGS. 4 and 5 corresponds generally to that of FIGS. 1 and 2 and the same reference numerals are employed and the various aspects of the boots which are the same will not be described in detail again. However, this embodiment employs a different tightening member 35 which can be seen in detail in FIG. 6.

Figure 6:
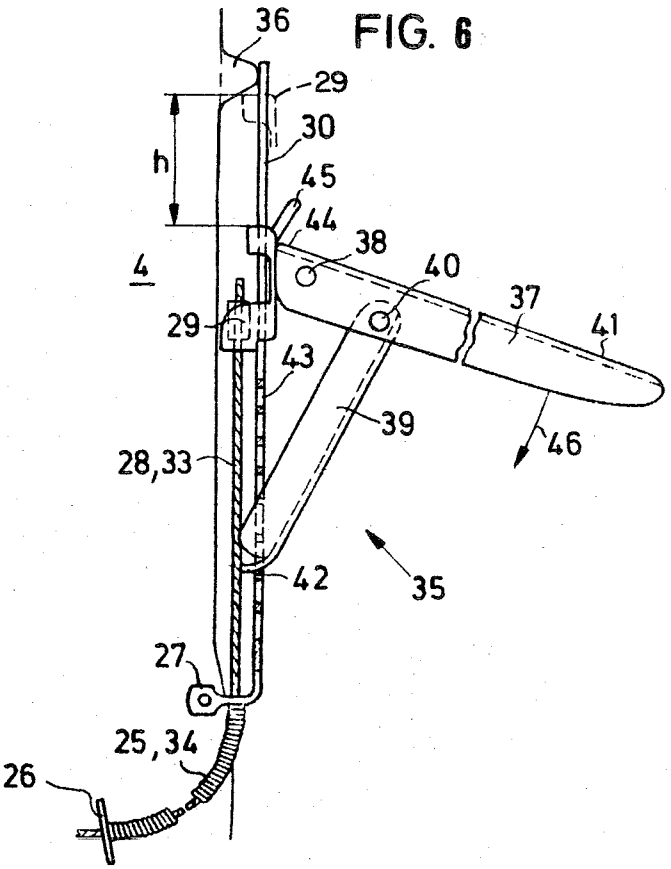
FIG. 6 is a partial side elevation, in partial section, of the tightening member of FIGS. 4 and 5, in the open position.

FIG. 6 shows only one of the ends 28 of the tightening cords 33, but the two ends are juxtaposed and fixed in slide member 29 which is displaceable on rail member 30. Slide member 29 is at a limited distance from plate 4 being fixed at the lower end by means of clip member 27 and the upper end by means of a support 36.

A tightening member 37, which is U-shaped in cross section, is pivotably mounted on an axle or spindle 38 which is attached to slide member 29. Lever 37 also carries a bracket 39, also U-shaped in cross section, which is pivotably connected to lever 37 by an axle or spindle 40 which is longitudinally spaced from spindle 38. Spindle 38 is closer to the back 41 of lever 37 than is spindle 40. Bracket 39 has a tongue 42 which can be inserted into any one of a plurality of grating-like openings 43 through rail member 30. Assuming that lever 37 is in the position shown in FIG. 6 and is then moved in the direction of arrow 46, ends 28 (FIG. 1) or tightening cords 33 (FIG. 2) are drawn upwardly and, consequently, the pull cords 18, 19 are tightened. In the closed position of tightening lever 37, i.e., in the tightened position, the lever directly engages on the calf side of the upper, as shown in FIGS. 4 and 5, while slide member 29 is located at the upper end of rail member 30 as shown by the dotted line position in FIG. 6, and has gone through a travel distance h which is shown in FIG. 6. This extent of travel corresponds to the tightening travel of partial cords 18, 19 which reaches double the value in the construction according to FIG. 2 because the tightening cords 34 engage on two members of turns 18', 19'.

Due to the different positions of spindles 38, 40 with respect to the back of the tightening lever 37, when the lever is in the tightened position and bracket 39 has been moved through an over-center or dead center position, lever 37 must initially be raised from this locked, over center position. Because the distance between spindles 38 and 40 and back 41 cannot be made arbitrarily large, it may be necessary to secure the tightened position of tightening lever 37 by means of a bolt flap 45.

Tightening of partial cords 18, 19 and of the boot can be performed in a simple manner using tightening member 35. After placing the foot in the boot, slide member 29 is raised to a suitable position with the aid of lever 37 such that tongue 42 can be introduced into one of the openings 43. Pressing down on tightening lever 37 leads to the further raising of slide member 29 so that the boot can be further tightened. If the tension is still not adequate, the lever 37 can be released again and tongue 42 of bracket 39 can be inserted into a higher one of openings 43 and the tightening process repeated. It is important that the tightening member 35 according to FIG. 6 constitutes a force-transmitting device enabling high tensile forces to be exerted on ends 28, or tightening cords 33, while require only relatively limited manual force. According to FIG. 6, these tensile forces can be produced in a toggle joint-like manner.

Force transmission can also take place in some other ways, for example, with the aid of a ratchet wheel which can be tensioned by tightening lever 37. However, in the tightened position it is desirable that tightening member 35 rise to the minimum possible extent from the boot upper.

The tightening member 35 according to FIGS. 1, 2, 4 and 5 can be used on different types of sports boots or shoes intended, for example, for skiing, ice hockey, speed skating and figure skating, in other words, wherever a full engagement between the boot and the foot is required. The parts of tightening member 35 can be made from metal, but tightening lever 37 can be made, for example, from a plastic material and its shape can be adapted in such a way that it forms a smooth transition to the upper. Using tightening member 35, the boot can be loosened and removed just as rapidly as it was tightened which is a considerable advantage compared to previous laced boots.

The embodiment according to FIGS. 2 and 5 is advantageous because, as stated herein before, due to the tightening travel of tightening cord 33 on turns 18', 19', approximately double the tightening travel is transmitted to pull cords 18, 19. In the case of two pull cords 18, 19 tightened by the two tightening cords 33, acting on the end turns 18', 19' of cords 18, 19, this means that with a displacement travel h of slide member 29, the total tightening travel in the two pull cords 18, 19 is approximately 4h. As a result, the tightening of the boot is considerable. However, the large tightening path or travel in pull cords 18, 19 also permit a wide opening of closing flaps 14 when inserting or removing the foot so that no additional means are required for this purpose.

Tightening lever 37 can advantageously be constructed in such a way that it is supported on slide member 29 when at approximately 90° to the rail member 30, and this can be achieved by a support wall 44 at the end on the slide member side. Thus, slide member 29 can be raised with the aid of tightening lever 37 and consequently the pull cord 18, 19 can easily be pretensioned, so that a single insertion of projection 42 into one of the openings 43 is adequate for tightening the boot.

In the embodiment according to FIGS. 1, 2, 4 and 5, upper 1 and shaft 4 can be made from leather or a plastic material and the same applies to the covering tongue 8. The inner shoe 6 with inner tongue 7 is made from a felt-like material, while the guide pieces 15, 16 and 21 are preferably made from metal or a plastic material and pull cord 17 is made from a wire rope.

While certain advantageous embodiments have been chosen to illustrate the invention it will be understood by those skilled in the art that various changes and modifications can be made therein without departing from the scope of the invention as defined in the appended claims.

What is claimed is:

1. An improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member, the improvement comprising:

a covering tongue coupled to the upper at the cap portion thereof, said covering tongue extending over the openable instep flaps;

mounting means on said covering tongue for receiving at least one turn of said pull cord; and means spaced from said covering tongue for receiving and guiding an end of said pull cord.

2. An improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member, the improvement comprising:

a covering tongue coupled to the upper at the cap portion thereof, said covering tongue extending over the openable instep flaps;

mounting means on said covering tongue for receiving a portion of said pull cord; and a guide member spaced from said covering tongue for receiving and guiding said pull cord, wherein said tongue is articulated and is reduced in width in the region of said mounting means.

3. A sports boot according to claim 1 wherein said mounting means comprises a slot extending longitudinally in said tongue through which said portion of said pull cord extends.

4. An improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member, the improvement comprising:

a covering tongue coupled to the upper at the cap portion thereof, said covering tongue extending over the openable instep flaps;

mounting means on said covering tongue for receiving a portion of said pull cord; and a guide member spaced from said covering tongue for receiving and guiding said pull cord, wherein said mounting means comprises a flexible hook attached to the inside of the covering tongue, in which said pull cord portions are inserted and passed out laterally below the tongue.

5. An improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member, the improvement comprising:

a covering tongue coupled to the upper at the cap portion thereof, said covering tongue extending over the openable instep flaps;

mounting means on said covering tongue for receiving a portion of said pull cord; and a guide member spaced from said covering tongue for receiving and guiding said pull cord, wherein said guide member is adjustably mounted on said leg plate, and includes means defining bores engageable in a pin or hook on said plate.

6. A sports boot according to claim 12, wherein the guide member is connected to a tightening cord and the tightening cord is located in a flexible guide of invariable length.

7. A sports boot according to claim 1, wherein the tightening member has a slide member fixed to one end of the pull cord, is displaceable on a rail member, and is provided with a hook which can be selectably engaged in one of a plurality of openings in said rail member.

8. A sports boot according to claim 1, wherein the tightening member has a slide member and a force-transmitting device with a tightening lever engaging on the slide member for the manual tightening of the boot.

9. A sports boot according to claim 8, wherein said tightening lever is pivotably mounted to the slide member via a first spindle and said tightening member includes a rail member and a bracket which is pivotably mounted via a second spindle on the tightening lever at a distance from the first spindle of the tightening lever and which at its free end has a projection insertable into a plurality of openings on the rail member for tightening the pull cord.

10. A sports boot according to claim 9, wherein the spindles are at different distances from the back of the tightening lever in such a way that the tightening length of said lever corresponds to an over-center position.

11. A sports boot according to claim 7, wherein said tightening means includes two pull cords, both fixed to the slide member and the displacement travel h of the slide member corresponds to the longitudinal displacement travel of approximately 4h on the turns when using said two pull cords.

12. An improved sports shoe or boot particularly for ice hockey having an upper with openable instep flaps for putting on and taking off the boot, a leg plate at least partially encompassing the calf side of the upper, tightening means including at least one pull cord and a tightening member, the pull cord passing alternately from one instep flap to the other and being guided by guide pieces attached to the flaps and attached to the tightening member, the improvement comprising:

a covering tongue coupled to the upper at the cap portion thereof, said covering tongue extending over the openable instep flaps;

mounting means on said covering tongue for receiving at least one turn of said pull cord; and a guide member spaced from said covering tongue for receiving at least one turn of said pull cord and guiding said pull cord.

13. A sports boot according to claim 1, wherein said mounting means comprises a slot in said covering tongue.

14. A sports boot according to claim 1, wherein said mounting means comprises a hook coupled to said covering tongue.

* * * * *